US005482110A

United States Patent [19]

Hartermann et al.

[11] Patent Number: 5,482,110

[45] Date of Patent: Jan. 9, 1996

[54] DEVICE FOR COOLING A DEPOSIT-FORMING GAS

[75] Inventors: Ralf-Uwe Hartermann, Wiehl; Hubert Scheid, Gummersbach; Reinald Schulze-Eckel, Munster; Joachim Papendick, Engelskirchen, all of Germany

[73] Assignee: L. & C. Steinmüller GmbH, Gummersbach, Germany

[21] Appl. No.: 278,877

[22] Filed: Jul. 22, 1994

[30] Foreign Application Priority Data

Jul. 22, 1993 [DE] Germany ..... 43 24 586.2

[51] Int. Cl.[6] ..... F28G 1/08

[52] U.S. Cl. ..... 165/84; 165/145

[58] Field of Search ..... 165/84, 145

[56] References Cited

U.S. PATENT DOCUMENTS 4,920,926 5/1990 Linke et al. ..... 165/84 X

FOREIGN PATENT DOCUMENTS 0314929 5/1989 European Pat. Off. .
0351563 1/1990 European Pat. Off. .
2404191 9/1978 France .
3137576 4/1983 Germany .
3725424 7/1988 Germany .
161823 1/1958 Sweden ..... 165/84
732104 6/1955 United Kingdom .

*Primary Examiner*—John C. Fox
*Attorney, Agent, or Firm*—Robert W. Becker & Associates

[57] ABSTRACT

A device for cooling a gas that forms deposits has an upright container through which the gas to be cooled flows. At least two heating surface units with at least one heating surface of a closed geometry are provided. The heating surface units are positioned within the upright container one atop the other. A cooling medium flows through the heating surface units. Each heating surface has coordinated therewith a beating device. The container has a support and an upper one of the heating surface units is supported at the support of the container. At least one array of connecting tubes for conveying the cooling medium is provided. The array of connecting tubes connects respectively a lower one of the heating surfaces units to an adjacent upper one of the heating surface units such that the cooling medium flows sequentially through the heating surface units. The array of connecting tubes has an open geometry such that a beating effect of the beating devices on the heating surfaces is unimpaired by the array of connecting tubes.

10 Claims, 2 Drawing Sheets

DEVICE FOR COOLING A DEPOSIT-FORMING GAS

BACKGROUND OF THE INVENTION

The present invention relates to a device for cooling a deposit-forming gas comprised of an upright container through which the gas flows, at least two heating surface units arranged within the container and formed of at least one heating surface of a closed geometry through which heating surface unit a cooling medium flows, and a plurality of beating devices coordinated with the individual heating surfaces for a mechanical cleaning of the heating surfaces.

Especially for the cooling of deposit-forming raw gases from pressure-loaded pyrolysis and gasification reactors for solid carbon-containing fuels it is required that individual heating surfaces are to be cleaned by beating devices which can be actuated during operation of the reactor. With the aid of preferably pneumatically operated beating devices the individual heating surfaces are accelerated to such an extent that the desired cleaning effect occurs (compare German Publication 31 37 576). However, the use of such cleaning systems has demonstrated that especially the constructive height of the heating surface units, i.e., their dimension in the flow direction of the gas to be cooled, cannot be increased indefinetly when a sufficient cleaning effect is to be achieved without the risk of damaging or destroying the heating surfaces. Therefore, it is known in the art to position separate from one another within the container heating surface units of a constructive height which can still be safely cleaned and to connect the heating surface units to the cooling medium circuit via separate connections that are guided through the container wall. In the disclosure and the claims of the aforementioned German publication a "closed geometry" for the heating surfaces refers to a design with which by beating on one location of the heating surface, respectively, on a limited number of locations, the entire heating surface can be accelerated such that a cleaning action is observed. This can be achieved especially by constructing the heating surfaces of the heating surface units in a tube-stay-tube or fin-tube construction, i.e., all tubes of one heating surface unit are rigidly connected to one constructive unit. It is furthermore known to assemble a heating surface unit as a package made of a plurality of nested heating surfaces of a closed geometry whereby the inner heating surface has a greater constructive height than the adjacent outer heating surface so that each heating surface can be beaten from the exterior without the need for penetrating any other heating surfaces of the heating surface unit.

It is an object of the present invention to provide a device of the aforementioned kind with which, on the one hand, the desired cleaning effect at the individual heating surface units is ensured and with which, on the other hand, it is not necessary to directly support each of the heating surface units at the container.

SUMMARY OF THE INVENTION

The device for cooling a gas that forms deposits according to the present invention is primarily characterized by:

An upright container through which a gas to be cooled flows;

At least two heating surface units comprised of at least one heating surface of a closed geometry, the at least two heating surface units positioned within the upright container one atop the other, wherein a cooling medium flows through the at least two heating surface units;

A plurality of beating devices wherein each heating surface has one of the beating devices coordinated therewith;

The container comprising a support, wherein an upper one of the at least two heating surface units is supported at the support of the container; and At least one array of connecting tubes for conveying the cooling medium, with the at least one array of connecting tubes connecting respectively a lower one of the at least two heating surface units to an adjacent upper one of the at least two heating surface units such that the cooling medium flows sequentially through the at least two heating surface units, wherein the at least one array of connecting tubes has an open geometry such that a beating effect of the beating devices on the heating surfaces is unimpaired by the at least one array of connecting tubes.

Preferably, each heating surface unit is comprised of a plurality of heating surfaces, the heating surfaces arranged in a nested configuration with a respective one of the heating surfaces projecting from a neighboring one of the heating surfaces such that the beating devices act independently on a coordinated one of the heating surfaces.

Preferably, a height of the heating surfaces in a direction of flow of the gas to be cooled is adjusted to a cleaning effect determined by an acceleration force exerted on the heating surfaces by the beating devices.

Advantageously, the connecting tubes extend substantially vertically and straight in a direction of flow of the gas to be cooled.

Expediently, in a first area of the upright container, in which first area the at least one array of connecting tubes is positioned, a free cross-section of the gas to be cooled is reduced such that a flow velocity of the gas to be cooled is increased in a second area of the upright container located downstream of the first area.

Preferably, the closed geometry of each heating surface is provided by using a tube-stay-tube construction or a fin-tube construction.

In a preferred embodiment of the present invention, the device further comprises an outer wall cooling surface supplied with the cooling medium. In yet another embodiment of the present invention the device further comprises an inner wall cooling surface supplied with a cooling medium, whereby the inner wall cooling surface delimits the flow of the gas to be cooled to an annular flow chamber.

Preferably, the device further comprises an inner wall cooling surface delimiting the flow of the gas to be cooled to an annular flow chamber, wherein the inner wall cooling surface is supplied with a cooling medium.

According to the present invention, the upper one of the heating surface units is supported at the container and the respective lower heating surface unit(s) is (are) connected with connecting tubes to the respective heating surface unit arranged above such that the cooling medium flows sequentially through the heating surface units. The connecting tubes between the heating surface units have an open geometry that does not impair the beating action on the individual heating surface units.

With this arrangement the upper heating surface unit of the device takes over a support function in conjunction with a corresponding support at the container. One or more heating surface units arranged downstream are supported via connecting tubes by the uppermost heating surface unit. The connecting tubes thus take over simultaneously the support of the weight of the heating surface units arranged downstream and provide also for the cooling medium connection. At the same time, due to the open geometry in the area of the array of connecting tubes between the heating surface units a mechanical decoupling takes place such that two adjacent heating surface units can be beaten safely and independently from one another by the respectively coordinated beating devices. The constructive height of the heating surface units with respect to the correlation between degree of soiling and cleaning effect by the beating action, i.e., the size of the cooling path, is determined independent of the operative area of the beating device based on the data of the cooling medium circuit within the permissible and thus optimized range.

With respect to the operation of the device it is possible, when repairs are required, to remove the heating surface units of the cooling path simultaneously from the container or to remove individual heating surface packages upon supporting the remaining heating surface units within the container after separation from the support and connecting tubes. A further advantage of the inventive device is that in an area between the heating surface units in which the connecting tubes are arranged a transverse exchange of the gas flow is possible so that a homogenization of the flow, temperature, and dust gradients within the cooling path of the represented device is possible.

Since the cooling medium flows through the heating surface units in a sequential pattern, a reduction of the number of collectors and distributors and a reduction of the number of tube penetrations of the container wall, respectively, of the wall heating surface arranged at the container, which delimits the flow path of the gas to be cooled, is achieved relative to the separate connection of the individual heating surface units.

Preferably, each heating surface unit is assembled in a manner known per se in a nested arrangement of a plurality of nested heating surfaces whereby a respective heating surface projects from a neighboring heating surface and whereby the coordinated beating devices act separately on the individual heating surfaces. The individual heating surfaces may be in the form of partition heating surfaces that are provided with tubes supplied with a cooling medium in the longitudinal or transverse direction (snake-like flow configuration) or they can be helically wound. The cross-section perpendicular to the direction of flow can be circular, square, polygonal, etc.

The constructive height of the heating surface units, respectively, of the heating surfaces in the direction of flow of the gas to be cooled is adjusted to the cleaning effect which corresponds to the acceleration that can be effected by the beating devices.

The connecting tubes extend preferably substantially vertically and straight in the direction of flow of the gas. This has the advantage that at the connecting tubes only a very small amount of erosion can take place because the connecting tubes extend in the direction of the flow of gas and not transverse to it.

A further improvement of the cleaning effect on the deposits forming on the heating surfaces can be achieved when beginning at the area of the connecting tubes the free flow cross-section of the gas is restricted such that the heating surface unit downstream of this constriction has a greater flow velocity. The increase of the gas flow velocity by reduction of the free flow cross-section reduces deposition by increasing the automatic cleaning effect. At the same time, gas velocities that are too low, especially during partial load, are prevented simultaneously to preventing the risk of bridge formation at the cold end of the device. Furthermore, due to the increase of the gas velocity in a downstream heating surface unit with the resulting simultaneous reduction of formation of deposits (fouling), the heating surface area of the downstream heating surface unit can be reduced.

In an advantageous manner the construction of the individual heating surfaces in a "closed geometry" (see supra) is achieved by using tube-stay-tube construction or fin-tube construction.

Furthermore, within the container in a manner known per se an outer wall cooling surface and/or an inner wall cooling surface, that delimits the flow of gas to an annular flow chamber, can be provided as is known from German Publication 31 37 576. These inner or outer wall cooling surfaces can also be supplied with the cooling medium.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
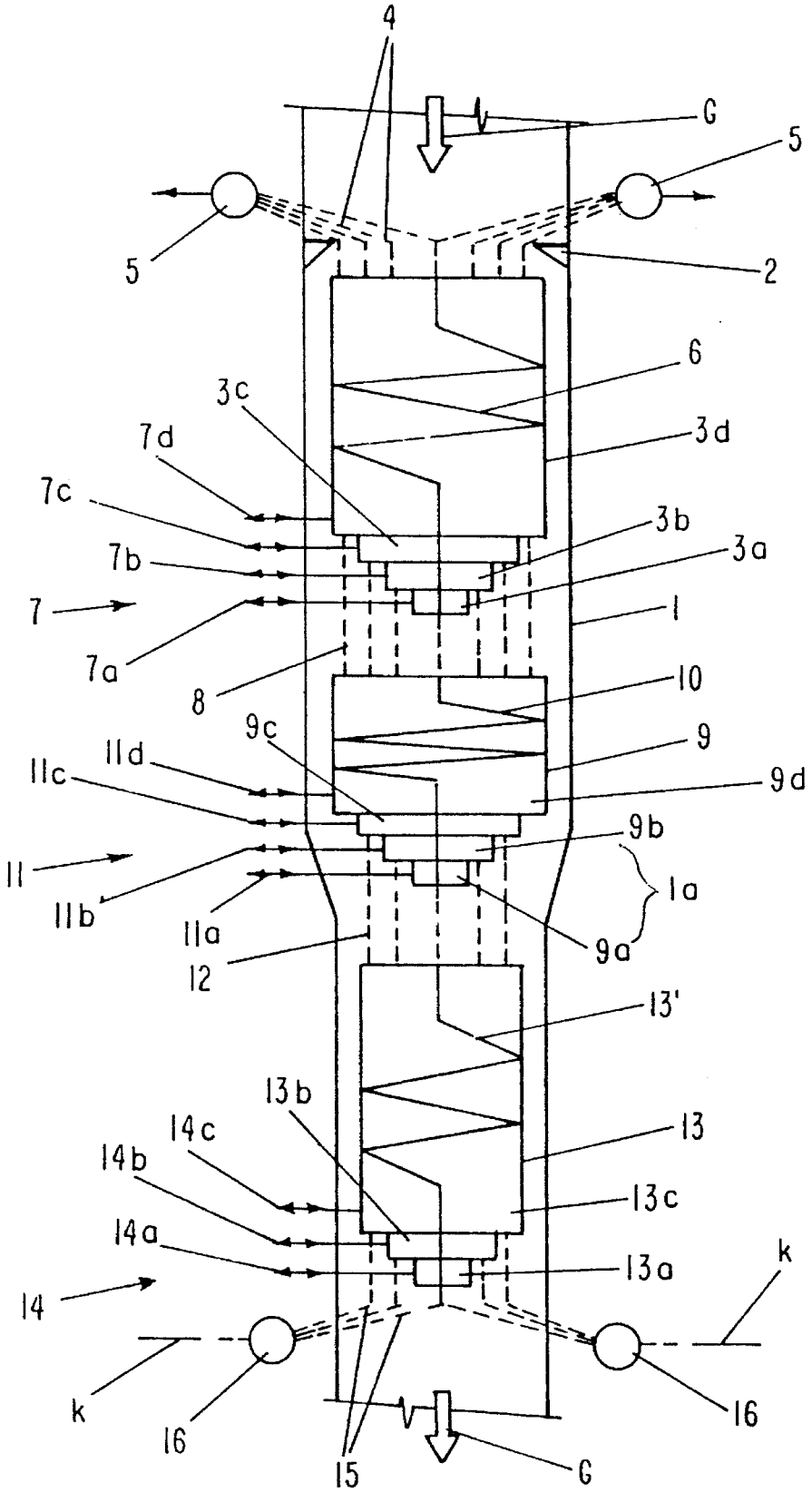
FIG. 1 shows a schematic longitudinal section of an upright container with three heating surface units.

The present invention will now be described in detail with the aid of several specific embodiments utilizing FIGS. 1 through 4.

A pressurized raw gas G to be cooled enters from the top a vertical upright container 1. At the inner wall of the container mantle a support 2 for a first heating surface unit 3 is provided. The heating surface unit 3 is comprised of nested heating surfaces 3*a*, 3*b*, 3*c*, and 3*d*. The heating surface unit 3 is connected via a plurality of connecting lines 4 with collectors 5 arranged exterior to the container 1. These connecting lines 4 also participate in the supporting action for the heating surface unit 3. The design of the cooling medium path within the heating surface unit 3, respectively, within the individual heating surfaces 3*a* to 3*d* are well known to a person skilled in the art. Therefore, the heating surfaces within the heating surface unit 3 are only symbolically represented by reference numeral 6 in FIG. 1. The heating surface 3*d* extends or projects past the adjacent heating surface 3*c*, the heating surface 3*c* projects past the adjacent heating surface 3*b*, and the heating surface 3*b* projects past the adjacent heating surface 3*a* so that the individual heating surfaces can be accelerated by schematically represented beating devices 7*a* to 7*d* in order to effect cleaning.

The heating surface unit 3, respectively, its individual heating surfaces 3*a* to 3*d* are connected with connecting tubes 8 to a further heating surface unit 9 comprised of heating surfaces 9*a*, 9*b*, 9*c*, and 9*d*. The connecting tubes 8 substantially extend in the direction of gas flow. The heating surfaces within the heating surface unit 9 are indicated at reference numeral 10. The individual heating surfaces 9*a* to 9*d* have coordinated therewith beating devices 11*a* to 11*d*. The design of the cooling medium path within the heating surface unit 9 is known in general to any person skilled in the art.

It is important for the present invention that the connecting tubes 8 form a zone of open geometry between tile closed geometry of the heating surface units 3 and 9 so that the heating surfaces 3*a* to 3*d* and 9*a* to 9*d* relative to the action of the beating devices at 7, respectively, at 11 are mechanically decoupled. The heating surface unit 9 supports via connecting tubes 12 a further heating surface unit 13 comprised of three heating surfaces 13*a*, 13*b*, and 13*c* which have coordinated therewith beating devices 14*a*, 14*b*, 14*c*. The heating surfaces within the heating surface unit 13 are referenced by reference numeral 13'.

At least a portion of the connecting tubes 8 and 12 takes over a supporting function for the heating surface units 9, respectively, 13 arranged downstream of the unit 3.

The heating surface unit 13, respectively, its heating surfaces 13*a* to 13*c* are connected via connecting lines 15 to distributors 16 so that the heating surfaces of the units 13, 9, and 3 are exposed in a counter flow to the gas G, entering the container 1 from the top, with respect to the cooling medium K (for example, water, steam) entering via the collector 16. Of course, the inventive device, if so desired, can also be operated in parallel flow whereby the gas G is introduced from the bottom of the container.

Upstream of the heating surface unit 13 the diameter of the container 1 is narrowed within the area 1*a* so that the velocity of the already partially cooled gas entering the heating surface unit 13 is increased in order to achieve the advantages described supra.

While in the represented embodiment the reduction of the free flow cross-section is provided by a reduction of the diameter of the container, such a reduction can also be achieved by changing the diameter of the cooling tubes in the heating surface unit arranged downstream, by changing the heating surfaces within the heating surface unit 13, by reducing the tube distribution within the individual heating surfaces, or by introducing an additional displacement body within the heating surfaces which displacement body is preferably in the form of an inner wall cooling surface.

In order to simplify the drawing, the container wall itself is represented as the limiting device for the flow of the gas G to be cooled. However, it is also possible that the limitation of the gas flow path is achieved by a separate wall heating surface and/or a sheet metal mantle and/or by a masonry wall as is known from German Patent 31 37 576 in the form of a wall heating surface and a masonry wall.

It is also possible that the distributor 16 and/or the collector 5 are arranged entirely or partially within the flow of the gas; however, they may also be arranged between the container wall and a separate wall heating surface, respectively, sheet metal mantles, respectively, a masonry wall.

When the gas to be cooled does not enter the container 1 from the top but from the side via a lateral raw gas inlet, the heating surface unit 3 is not supported by a support 2 at the side wall of the container, but it is advantageous to support the heating surface unit 3 and thus the heating surface units 9 and 13 from the roof or ceiling construction of the container.

Figure 2:
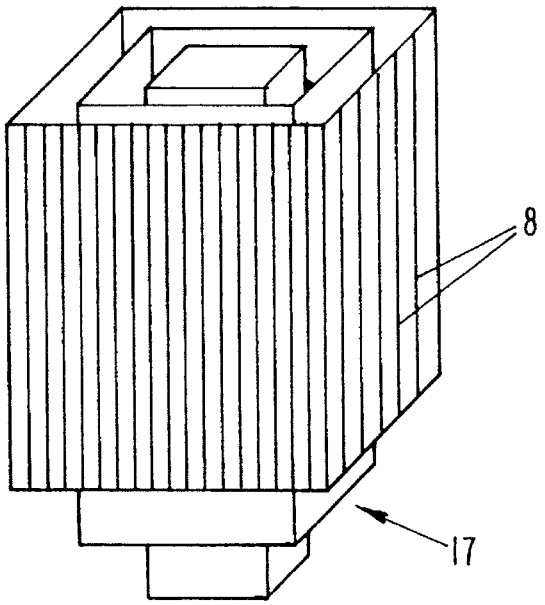
FIGS. 2 to 4 show different embodiments of heating surface units, respectively.

In the embodiment according to FIG. 2 the heating surface unit 17 is comprised of three heating surfaces in which the tubes 18 extend parallel to the flow direction of the gas and which have a square cross-section.

Figure 3:
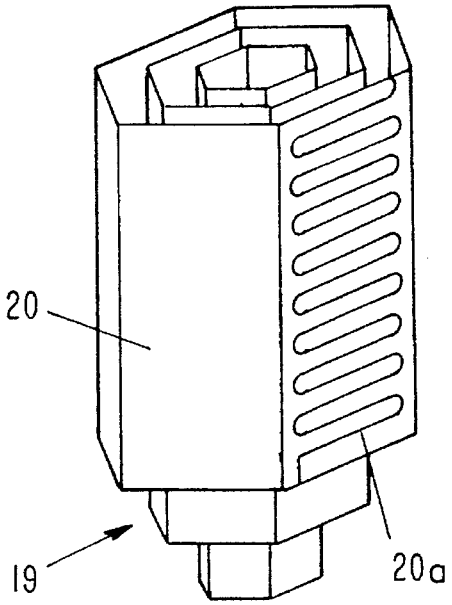

The heating surface unit 19 represented in FIG. 3 is comprised of individual heating surfaces 20 comprised of partitioned heating surfaces 20*a* with tubes for a transverse flow whereby the tubes have a polygonal cross-section.

Figure 4:
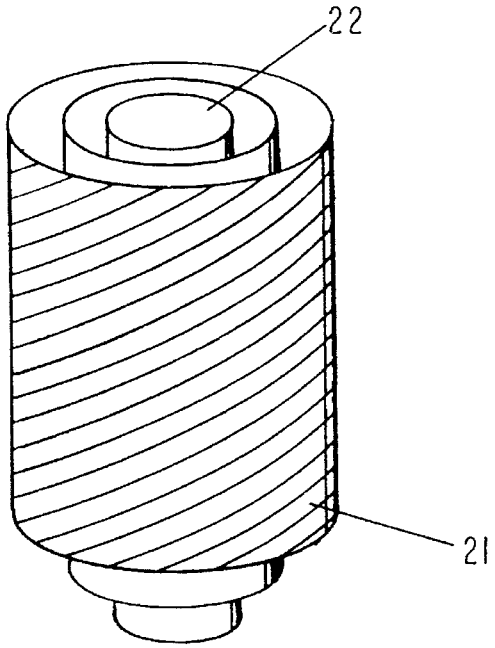

In the embodiment according to FIG. 4 the heating surface unit 21 is provided with a plurality of helically wound heating surfaces 22. The embodiments of FIGS. 2 to 4 show examples for heating surface units of a closed geometry in a welded fin-tube or tube-stay-tube construction, whereby the cooling tube can be arranged in any desired configuration.

The present invention is, of course, in no way restricted to the specific disclosure of the specification and drawings, but also encompasses any modifications within the scope of the appended claims.

What we claim is:

1. A device for cooling a gas that forms deposits, said device comprising:

an upright container through which a gas to be cooled flows;

at least two heating surface units comprised of at least one heating surface of a closed geometry, said at least two heating surface units positioned within said upright container one atop the other, wherein a cooling medium flows through said at least two heating surface units;

a plurality of beating devices, wherein each said heating surface has one said beating device coordinated therewith;

said container comprising a support, wherein an upper one of said at least two heating surface units is supported at said support of said container; and at least one array of connecting tubes for conveying the cooling medium, with said at least one array of connecting tubes connecting respectively a lower one of said at least two heating surface units to an adjacent upper one of said at least two heating surface units such that said lower one of said at least two heating surface units is suspended by said connecting tubes and such that the cooling medium flows sequentially through said at least two heating surface units, wherein said at least one array of connecting tubes has an open geometry such that a beating effect of said beating devices on said heating surfaces is unimpaired by said at least one array of connecting tubes.

2. A device according to claim 1, wherein each said heating surface unit is comprised of a plurality of said heating surfaces, said heating surfaces arranged in a nested configuration with a respective one of said heating surfaces projecting from a neighboring one of said heating surfaces such that said beating devices act independently on a coordinated one of said heating surfaces.

3. A device according to claim 1, wherein a height of said heating surfaces in a direction of flow of the gas to be cooled is adjusted to a cleaning effect determined by an acceleration force exerted on said heating surfaces by said beating devices.

4. A device according to claim 1, wherein said connecting tubes extends substantially vertically and straight in a direction of flow of the gas to be cooled.

5. A device according to claim 1, wherein in a first area of said upright container, in which first area said at least one array of said connecting tubes is positioned, a free cross-section of the gas to be cooled is reduced such that a flow velocity of the gas to be cooled is increased in a second area of said upright container located downstream of said first area.

6. A device according to claim 1, wherein said closed geometry of each said heating surface is provided by using a tube-stay-tube construction.

7. A device according to claim 1, wherein said closed geometry of each said heating surface is provided by using a fin-tube construction.

8. A device according to claim 1, further comprising an outer wall cooling surface supplied with the cooling medium.

9. A device according to claim 8, further comprising an inner wall cooling surface supplied with the cooling medium, said inner wall cooling surface delimiting the flow of the gas to be cooled to an annular flow chamber.

10. A device according to claim 1, further comprising an inner wall cooling surface, delimiting the flow of the gas to be cooled to an annular flow chamber, said inner wall cooling surface supplied with the cooling medium.

* * * * *